US010172432B2

(12) United States Patent
Paquet

(10) Patent No.: US 10,172,432 B2
(45) Date of Patent: Jan. 8, 2019

(54) APPLICATOR FOR SEMI-SOLID MATERIALS

(71) Applicant: Intel Plastics Inc., Toronto, Ontario (CA)

(72) Inventor: Ken Paquet, North York (CA)

(73) Assignee: Intel Plastics Inc., Toronto (CA)

( * ) Notice: Subject to any disclaimer, the term of this patent is extended or adjusted under 35 U.S.C. 154(b) by 196 days.

(21) Appl. No.: 15/330,500

(22) PCT Filed: May 5, 2015

(86) PCT No.: PCT/IB2015/053286

§ 371 (c)(1),
(2) Date: Sep. 28, 2016

(87) PCT Pub. No.: WO2015/177669

PCT Pub. Date: Nov. 26, 2015

(65) Prior Publication Data

US 2017/0007003 A1 Jan. 12, 2017

Related U.S. Application Data

(60) Provisional application No. 61/997,006, filed on May 20, 2014, provisional application No. 62/125,769, filed on Feb. 2, 2015.

(51) Int. Cl.
*A45D 40/02* (2006.01)
*A45D 40/00* (2006.01)
(Continued)

(52) U.S. Cl.
CPC ..... *A45D 40/02* (2013.01); *A45D 40/00* (2013.01); *A45D 40/12* (2013.01); *A45D 2040/105* (2013.01)

(58) Field of Classification Search
CPC ..... A45D 40/02; A45D 40/10; A45D 40/12; A45D 40/0087; A45D 2040/0025;
(Continued)

(56) References Cited

U.S. PATENT DOCUMENTS 3,032,180 A 5/1962 Grisel
3,061,084 A * 10/1962 Tibbitts ..... A45D 40/02 401/102

(Continued)

FOREIGN PATENT DOCUMENTS

WO WO 02/03830 1/2002
WO WO 02/067721 A1 9/2002

*Primary Examiner* — Jennifer C Chiang
*Assistant Examiner* — Bradley Oliver

(57) ABSTRACT

An applicator for a stick product, such as lip balm, has a generally tubular housing closed at one end by an elastomeric base cap and at the other by an end cap. The base cap is connected to one end of a plunger shaft, and at the other end the shaft is connected to a tray holding a semi-solid mass of the stick product. The end cap is in the form of a mold so that the stick product may be molded onto the tray in situ. The end cap locks to the housing to cover the semi-solid mass, and when removed the base cap (e. g. durometer 70A), which is bistable, having two relaxed configurations, may be depressed to move the mass out of the housing. The plunger and stick product are easily replaced.

20 Claims, 7 Drawing Sheets

(51) Int. Cl.
*A45D 40/12* (2006.01)
*A45D 40/10* (2006.01)

(58) Field of Classification Search
CPC ..... A45D 2040/0043; A45D 2040/005; A45D 2040/0031; A45D 2040/105; A45D 2040/207; A45D 2200/053
See application file for complete search history.

(56) References Cited

U.S. PATENT DOCUMENTS 3,397,027 A * 8/1968 Harrison ..... A45D 40/02 401/50
4,139,311 A * 2/1979 Lorscheidt ..... A45D 40/02 215/341
4,452,425 A 6/1984 Lacking
5,799,667 A 5/1998 Szekely
5,800,086 A * 9/1998 Piscopo ..... A45D 40/02 401/82
5,897,263 A 4/1999 Fattori
5,944,434 A * 8/1999 Schlatter ..... A45D 40/02 401/176
5,984,553 A 11/1999 Piscopo
6,193,427 B1 2/2001 Benguigui
6,890,115 B2 5/2005 Le Moing
7,021,849 B2 4/2006 Ramet
7,695,727 B2 4/2010 Magee et al.
7,802,937 B1 9/2010 Szekely
7,997,461 B2 8/2011 Lester et al.
D644,939 S 9/2011 Teller
8,215,857 B2 7/2012 Carroll
8,444,337 B2 5/2013 Teller
8,651,308 B1 2/2014 Sung
8,888,391 B2 11/2014 Teller et al.
2002/0056660 A1* 5/2002 Gueret ..... A45D 40/0068 132/314
2003/0133737 A1* 7/2003 Le Moing ..... A45D 40/02 401/62
2004/0213626 A1 10/2004 Ramet
2006/0198692 A1* 9/2006 Petit ..... A45D 33/025 401/266
2006/0285913 A1* 12/2006 Koptis ..... A45D 40/26 401/205
2015/0289628 A1* 10/2015 Kim ..... A45D 40/02 222/386
2017/0258200 A1* 9/2017 Rossi ..... A45D 40/16

* cited by examiner

APPLICATOR FOR SEMI-SOLID MATERIALS

CROSS-REFERENCE TO RELATED APPLICATIONS

This application claims the benefit of U.S. Provisional Applications 61/997,006 filed May 20, 2014 and 62/125,769 filed Feb. 2, 2015, the disclosures of which are incorporated by reference herein.

BACKGROUND AND SUMMARY OF THE INVENTION

The invention relates to an applicator for semi-solid materials, sometimes called "stick products," including but not limited to lip balm (such as shown in U.S. Pat. No. 7,695,727 and the prior art discussed therein), sunscreen, skin balm, analgesic balm, lipstick, deodorant, and make-up. The applicator according to the invention is simple and easy to use, simple and inexpensive to manufacture, versatile, and aesthetic. The applicator is also easily refillable and therefore more environmentally sound than other tangentially related products such as shown in U.S. Pat. Nos. 5,799,667, 6,193,427, and 8,444,337, and is expected to have a long shelf life. The applicator is also easy to use to effectively apply stick products to a human's body, including lips, underarms, or other portions of skin.

According to one aspect of the invention, a stick product semi-solid material applicator is provided which comprises: A generally tubular housing having first and second open ends. An elastomeric material base cap closing the housing first end. A plunger having first and second ends, the plunger first end operatively connected to the flexible material cap. A mass of semi-solid material stick product mounted on the second end of the plunger. And, at least one readily removable end cap covering the housing second end. The end cap is movable from a first position in which it covers the semi-solid material to preclude access thereto, and a second position in which the semi-solid material can extend at least partially out the housing second end.

The elastomeric material base cap may be concave in relaxed position so as to bias the semi-solid material to the second position extending at least partially out of the second end of the housing. Preferably, however, the elastomeric material base cap is a bistable element which moves from a first stable configuration in which the semi-solid material is primarily within the housing to, after removal of the end cap and manual actuation thereof, a second stable configuration in which the semi-solid mass is substantially completely exterior of the housing. The base cap may be of urethane or a similar thermoplastic material, and desirably has a durometer of about 40-90 (e. g. about 70) on the Shore A scale.

The applicator also desirably includes at least one stop in the interior of the housing between the first and second ends thereof for stopping the movement of the plunger at a desired position. Also, the at least one end cap preferably comprises a mold for the semi-solid material to allow in situ molding thereof on the plunger. Compatible projections are provided on the housing adjacent the second end thereof, and on the end cap, to provide releasable locking connection of the end cap to the housing.

Desirably, the plunger comprises a shaft and a tray which holds the semi-solid material, the tray having a peripheral section devoid of semi-solid material; and wherein the end cap can engage the peripheral section to move the semi-solid material from the second position to the first position thereof without adversely affecting the semi-solid material. The plunger also may comprise a disc (integral with or detached from the shaft) adjacent the second end of the shaft which cooperates with the tray to minimize contact of the semi-solid material with air inside the housing. The plunger shaft and tray may have cooperating surface manifestations to allow releasable connection of one to the other, or may be integral. The plunger also has a knob and recess at the first end thereof which cooperates with surface manifestations on the elastomeric material base cap to allow ready replacement of the plunger and semi-solid material mass.

Preferably, a guide is provided mounted within the housing between the first and second ends thereof which guides reciprocal movement of the plunger. The guide cooperates with vertical ribs on the plunger that define a diameter or other cross-sectional dimension that is the same as, or slightly greater than, the diameter or other cross-sectional dimension of the plunger knob.

The generally tubular housing can have a wide variety of different shapes including a uniform diameter circle in cross-section, a uniform or tapered polygon (e. g. hexagon) in cross-section, or it may have tapering side walls at least one of which is substantially flat.

According to another aspect of the invention there is provided a method of assembling an applicator unit with a semi-solid stick product, the applicator unit including a plunger shaft, a plunger tray having openings and surface manifestations (such as tabs) therein, and an end cap having an open top and a bottom in the form of a mold. The method is characterized by: a) Placing the tray on the open top of the end cap. b) Filling the bottom of the end cap with flowable stick product so that it passes through the openings in the plunger tray and engages the surface manifestations. c) Allowing the flowable stick product to cool or otherwise set into a semi-solid mass attached to the plunger tray but not attached to the end cap bottom. And d) ensuring that the plunger shaft is in operative association with the plunger tray so that the tray and semi-solid mass move with the plunger shaft.

The method is desirably for use with a generally tubular applicator housing having a bistable elastomeric material base cap, and is further characterized by: e) Moving an end of the plunger shaft opposite the tray into contact with the elastomeric material base cap so that they are releasably connected together. f) Pushing the end cap into operative association with surface manifestations on the end of the housing opposite the base cap so that they releasable lock together. And g) removing the end cap and acting on the bistable base cap so that the base cap biases the semi-solid mass of stick product out of the housing for use on a user's body.

According to yet another aspect of the present invention there is provided an applicator, comprising: A bistable body of elastomeric material having a peripheral portion with inner and outer surfaces, and a center portion with top and bottom surfaces, the center portion top surface having a convex shape in a first relaxed configuration, and a concave shape in a second relaxed configuration, and the center portion bottom surface having a depending center tubular element. Surface manifestations in the interior of the center tubular element for cooperation with a knob and recess of a plunger. And surface manifestations on the inner surface of the peripheral portion for cooperation with a housing for an applicator. The cap is desirably made of a thermoplastic material with properties comparable to those of urethane and has a durometer of between about 40-90 (e. g. about 70) on the Shore A scale.

It is the primary object of the present invention to provide a particularly desirable applicator for stick products, such as lip balm, a novel base cap for the applicator, and a method of assembly and utilization of the applicator. This and other objects of the invention will become clear from a detailed description of the drawings, and from the appended claims.

DETAILED DESCRIPTION OF THE DRAWINGS

Figure 1:
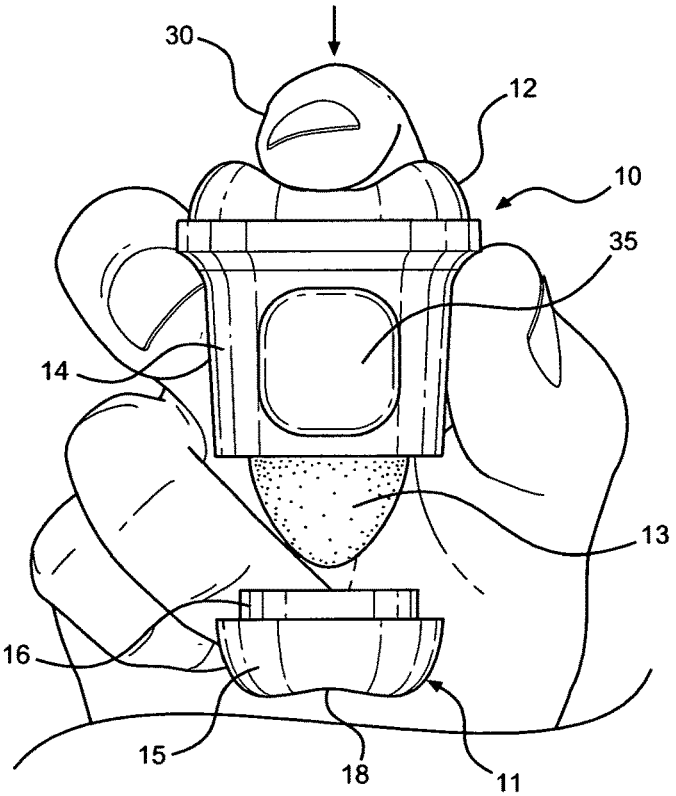
FIG. 1 is schematic side view of one exemplary embodiment of an applicator according to the invention with the end cap removed and the base cap depressed by the human user so that the stick product is in position to be applied to a user's body.

FIG. 1 shows an exemplary applicator 10 according to the invention, approximately to scale for a preferred size, in a human user's hand with the end cap 11 removed and the elastomeric material base cap 12 depressed so that the mass of semi-solid material stick product (such as lip balm) 13 (which preferably has the generally conical shape illustrated) is available to be applied to the human user's body, or some other object.

The main body 14 of the applicator 10 is preferably molded of polypropylene (PP) or a similar plastic. The end cap 11 in this embodiment is two-part, including an outer textured cap 15 desirably made of PP or a similar plastic, and an inner cap 16 made of high density polyethylene (HDPE) or a similar plastic. The elastomeric material forming the base cap 12 may be any suitable thermoplastic elastomeric material (such as silicone rubber, natural rubber, urethane or polyurethane) and may have a Shore A Scale hardness of between about 40-90, as long as the cap 12 acts like a spring and returns the mass of semi-solid material 13 to a position primarily within the main body 14 when the user's finger pressure depressing the cap 12 is terminated.

Figure 2:
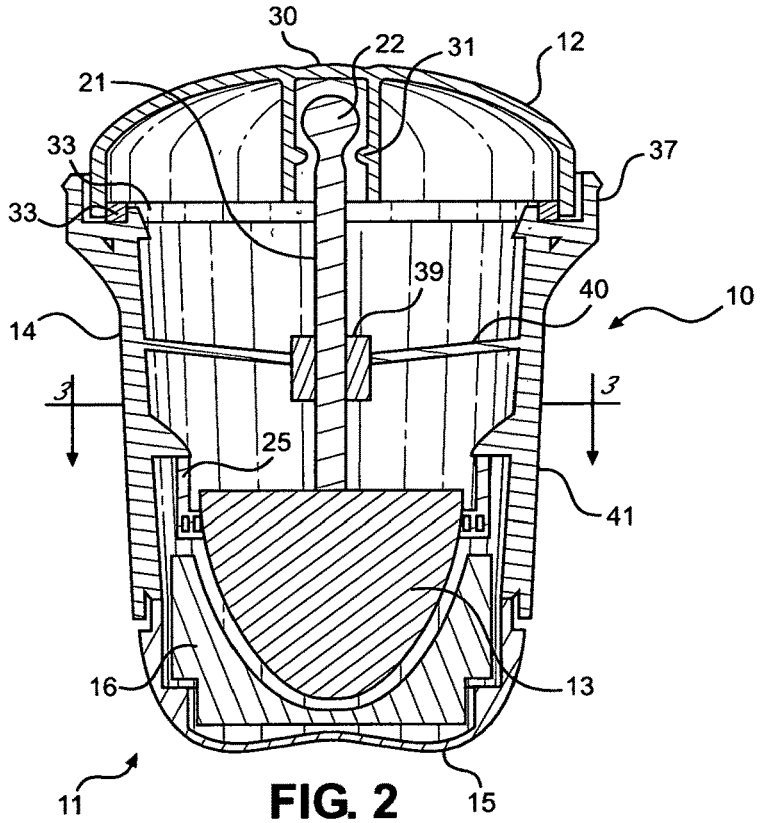
FIG. 2 is longitudinal cross-sectional view of the applicator of FIG. 1 with the semi-solid mass shown in elevation.
Figure 3:
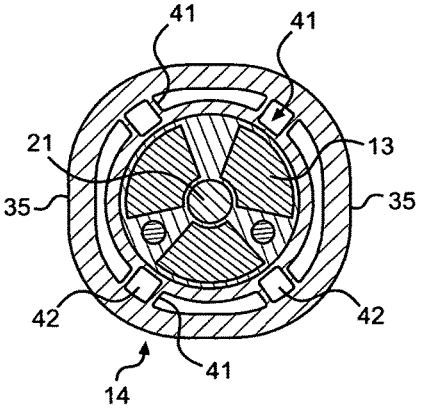
FIG. 3 is cross-sectional view of the applicator taken along lines 3-3 of FIG. 2.
Figure 4:
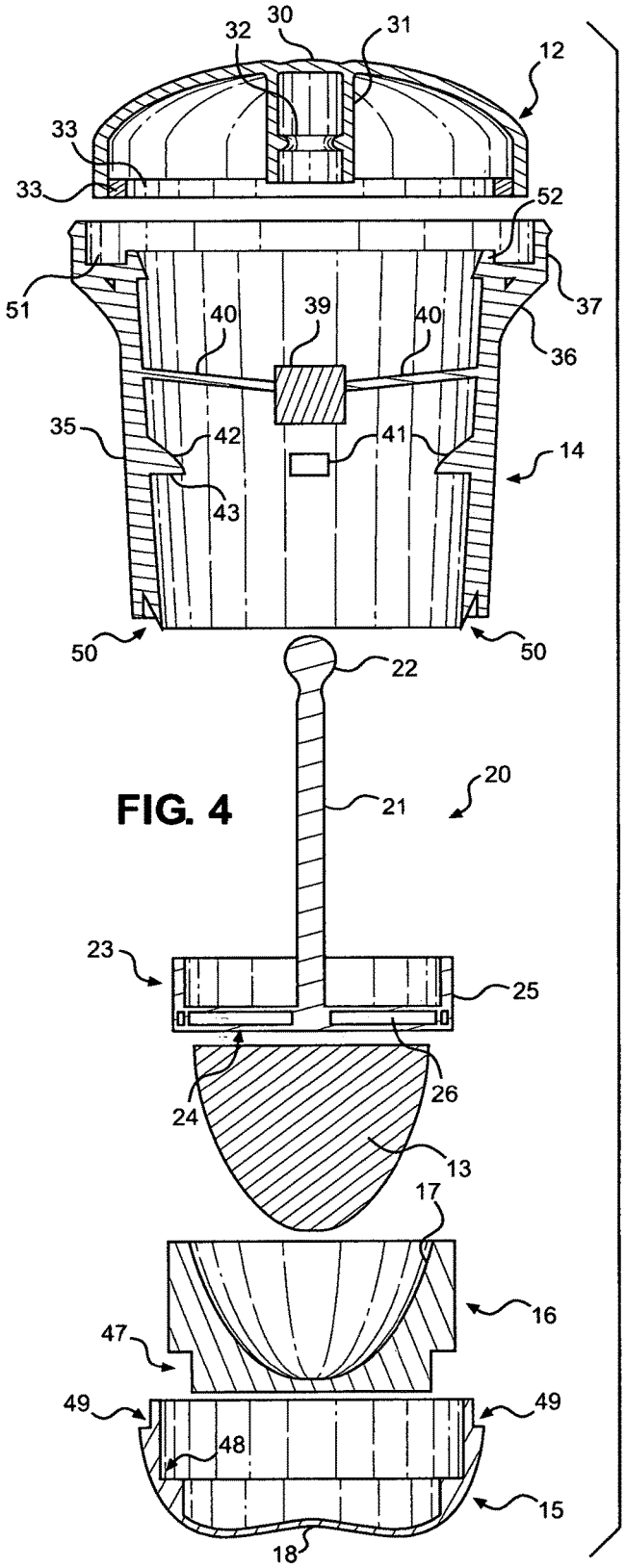
FIG. 4 is an exploded view, primarily in cross-section with portions in elevation, of the applicator of FIGS. 1-3.

FIG. 2 is a side cross-sectional view (all other side cross-sectional views would be substantially the same) of the applicator 10 (to a different scale) with the end cap 11 in place, and with the semi-solid mass 13 shown in elevation. FIG. 3 is a cross-sectional view taken along lines 3-3 of FIG. 2 while FIG. 4 is an exploded cross-sectional view (with the mass of semi-solid material, e. g. lip balm, 13 shown in elevation) of the applicator 10 of FIGS. 1-3.

The element 14 defines a generally tubular housing. While the housing may have a substantially constant diameter circular cross-section, as illustrated in FIGS. 1-4, it may have a wide variety of other shapes. For example it may have a polygonal shape (e. g. hexagon) with constant or tapering cross-sectional dimension, or it may have tapering side walls at least one of which provides a substantially flat surface (e. g. for attachment of a label or in mold labelling).

The mass of semi-solid material 13 may be formed in situ in the applicator 10 before final assembly thereof, or may be formed exteriorly of the applicator unit 10 and then inserted after formation. In either event in a preferred embodiment the semi-solid material 13 is heated or otherwise acted upon to become flowable, and then put into a mold with the movable plunger 20 positioned adjacent the mold. If the mass 13 is formed in situ then the inner end cap 16, which defines an interior conical cavity 17 (see FIG. 4), serves as the mold. In circumstances where it is desirable that the mass have a shape different than a cone (e. g. a rectangular parallelepiped or half-sphere) the cavity 17 will have a corresponding shape.

If desired, the outer end cap 15 has a recess 18 in the bottom thereof (see FIGS. 1 and 4) which facilitates standing of the outer end cap 11 on a flat surface when not covering the mass 13.

As seen in FIG. 4, the movable (e. g. reciprocal) plunger 20, which may be made of HDPE, PP, or a similar plastic, includes a shaft 21 having an upper protuberance 22, and a base or tray 23. In the embodiment illustrated in FIG. 4, the base/tray 23 comprises a disc-shaped bottom 24 with an upstanding peripheral side wall 25. The disc-shaped bottom 24 has one or more (e. g. three) openings 26 therein. Whether formed in situ or externally of the unit 10, the semi-solid mass 13 ultimately has portions thereof on both the top and bottom of the disc 24 (extending through the openings 26), within the volume defined by the side wall 25, and surrounding the shaft 21 at the bottom thereof.

As seen in FIG. 4, the base cap 12 of the embodiment illustrated therein has a dome shape, preferably with a flattened upper center portion 30 which facilitates positioning of the index finger of the human user when operating the applicator 10. Interiorly of the dome shape of the base cap 12 is a central tube 31 into which the plunger 20 protuberance/knob 22 extends. The interior of tube 31 preferably contains a ring 32 of material extending inwardly and defining a center portion of the interior of tube 31 that has a diameter (or other cross-sectional dimension) less than that of the protuberance 22. With this configuration, once the cap 12 is pushed down over the protuberance 22, the engagement between the protuberance 22 and the ring 32 causes the material of tube 31 to flex outwardly until the protuberance 22 snaps into place above the ring 32 within the tube 31. This cooperation between components holds the elements 12, 20 together during normal use. However, should the user desire to replace the plunger 20 and semi-solid mass 13 at some point, the cap 12 and plunger 20 can be detached from each other by pulling hard on the plunger 20 while holding the cap 12 steady.

The base cap 12 can also have an interior outer ring 33 which cooperates with the top of the main body 14 to hold the base cap 12 in place on the housing 14 at the outer circumference of the base cap 12, while still allowing depression of the base cap 12 at the central flat portion 30 thereof.

As earlier indicated, the main housing 14 in the FIGS. 1-4 embodiment is generally tubular, but may be provided with flattened side portions 35, and with a tapered portion 36 below a top rim 37. The portions 35, 36 facilitate gripping of the unit 10 by the human user, in turn enabling easy utilization of the unit 10 to apply lip balm, or other semi-solid material 13, to parts of the user's body, or other surfaces.

Interiorly of the housing 14, as seen in FIG. 4, is a center guide structure. The guide structure is preferably molded of the same material as the body 14 and integral therewith. In the preferred embodiment illustrated structure includes a hollow central hub 39 through which the shaft 21 extends. The hub 39 is supported by a plurality (e. g. four) of struts 40. The hub 39 prevents the shaft 21 from deflecting too much in any direction as it is reciprocated when the base cap 12 is depressed.

Also formed interiorly of the housing 14 are a plurality (e. g. four) of stops 41 which optionally may allow the base 23 of the plunger 20 to be inserted from the top into the housing 14, but which engage the peripheral side wall 25 of the plunger 20 to prevent undesired upward movement of the shaft 21. Each stop 41 (very schematically illustrated in FIGS. 2-6) can be integrally molded with housing 14 positioned in alignment with a strut 40. The top 42 of each stop 41 may have an inward slope which can, under some circumstances although the components would not normally be assembled that way, allow the base 24 of plunger 20 to move past the stops 41, but a horizontal bottom 43 which engages the top of the side wall 25 to prevent upward movement past the stops 41 (see FIG. 4).

The inner bottom cap 16 may be fixed to the outer bottom cap 15 either permanently, or releasably. For example an adhesive (not shown) may be placed between the surfaces 47, 48 (see FIG. 4) of the caps 15, 16, respectively, to hold them together, or they may be plastic (e. g. ultrasonically) welded together. Alternatively, there may be a conventional twist or rib lock (such as generally shown in U.S. Pat. No. 4,279,355) between the surfaces 47, 48.

The outer bottom cap 15 also has a releasable connection to the bottom of the housing 14. This releasable connection, between the surfaces 49, 50 of the elements 15, 14, respectively, schematically illustrated in FIG. 4, may also comprise a conventional twist or rib lock (e. g. as in U.S. Pat. No. 4,279,355), or any other suitable conventional releasable interconnection.

In one exemplary manner of assembly of the components of the applicator 10, the semi-solid mass 13 is formed in situ. In this scenario the plunger 20 is inserted into the housing 14 through the open bottom of housing 14. The protuberance 22 and shaft 21 are passed through the center opening in the hub 39, which opening is just large enough to accommodate the protuberance 22, but small enough so that it prevents too much lateral movement of the shaft 21 during reciprocation thereof. The plunger 20 is inserted until the top of side wall 25 thereof engages the bottoms 43 of stops 41.

In the next assembly step the lower cap 11 is releasably connected to the housing 14, such as by the twist locks provided by the surfaces 49, 50 between the outer bottom cap 15 and the bottom of the housing 14, as described above with respect to FIG. 4. In this way the conical interior opening 17 of the inner lower cap 16 is in place to serve as a mold.

In the next assembly step the semi-solid material (e.g. lip balm) in hot liquid or other flowable form is poured into the main body 14 through the open top thereof. The liquid flows through the openings 26 in the disc-shaped bottom 24 of the base 23 of plunger 20 and hits the inner conical form 17 of the inner bottom cap 16, which acts as a mold. Liquid is poured into the body 14 until its level is past the top of the disc-shaped bottom 24, but below the top of the peripheral sidewall 25. When the hot liquid cools, or the otherwise flowable material sets, the conical semi-solid mass 13 is formed, held securely to the plunger 20.

In the final assembly step, the base cap 12 is placed onto the top of the housing 14, assuming the position illustrated in FIG. 2. In that position the bottom lip-ring 33 of the cap 12 (FIG. 2) extends into the open area 51 (FIG. 4) at the top inner periphery of the rim 37 of housing 14 and may lock with the projection 52. Alternatively, the cap 12 could be substantially permanently attached to the body 14, such as by plastic welding or by an adhesive.

A human uses the applicator unit 10 by removing the bottom cap 11, such as by twisting it one-quarter turn to release a conventional twist lock between surfaces 49, 50. Then the base cap 12 is depressed by the user's index finger, as seen in FIG. 1, to reciprocate the plunger 20 and move the semi-solid mass (e. g. lip balm) 13 almost completely out of the/housing 14. While the mass 13 is in the position illustrated in FIG. 2 it can be applied to a part of the user's body (e. g. her/his lips if it is lip balm), or some other surface, depending upon the composition and intended use of the mass 13. When application is completed, the user simply pulls her/his finger out of engagement with the base cap 12, and the elastomeric material of cap 12 causes the plunger 20 to spring upwardly (until the top of side wall 25 engages the bottoms 43 of the stops 41) so that the mass 13 is almost completely within the housing 14 and so that the lower cap 11 may be re-connected to the housing 14.

When the semi-solid material mass 13 has been used up, or another type of semi-solid material is desired to be applied using the applicator 10, it is easily replaced. This can be accomplished in a number of different ways, two of which will be described.

In the first manner of replacing the mass 13, the lower cap 11 is removed. The user then completely depresses the base cap 12 so that the connection between the protuberance 22 and the ring 32 is as weak as possible. Then the user grabs the side wall 25, or the remaining portion of the mass 13, with her or his fingers, or preferably with a tongs (not shown) or other tool designed for that purpose, and pulls downwardly on the plunger 20. This moves the protuberance 22 out of the inner tube 31 of cap 12, and allows continued extraction of the plunger 20 through the center opening in hub 39 and then out of the open bottom of the housing 14.

A new plunger 20, with new semi-solid mass 13 (as those components are illustrated in FIG. 2), which has been made exteriorly of unit 10 using an exterior mold similar to the mold 16, 17, is then inserted through the open bottom of the housing 14. This insertion is accomplished so that the protuberance 22 on the shaft 21 of the new plunger 20 passes through the central opening in hub 39 and then into the inner tube 31 of the base cap 12 until there is a snap fit between the protuberance 22 and inner ring 32. The insertion may also be facilitated by using a tongs or other tool specifically designed for that purpose. The material 13 may be covered with a paper or plastic covering until the insertion process is completed, which paper or plastic covering is then easily removed.

In a second manner of replacing the mass 13, with the lower cap 11 in place the user grips the peripheral edge of the base cap 12 with her/his fingers and lifts up while holding the housing 14 steady. This detaches the protuberance 22 from the cap 12 and moves ring 33 past projection 52 (FIG. 4). Then the user detaches the lower cap 11 (e. g. by a one-quarter twist to release the locking surfaces 49, 50) and removes the existing plunger 20 and any remaining mass 13 thereon, in the same manner as described for the first manner (e. g. with tongs). The new plunger 20 and mass 13 are then inserted also as described for the first manner. If desired a new inner end cap 16 may also be provided for the plunger 20 and mass 13. In that case the old inner lower cap 16 is detached (e. g. by twisting) from the existing outer lower cap 15, and the new end cap element 16 connected to the existing end cap element 15. Reconnection of the base cap 12 to the new plunger shaft 21/protuberance 22, is accomplished just as in the first manner.

Figure 6:
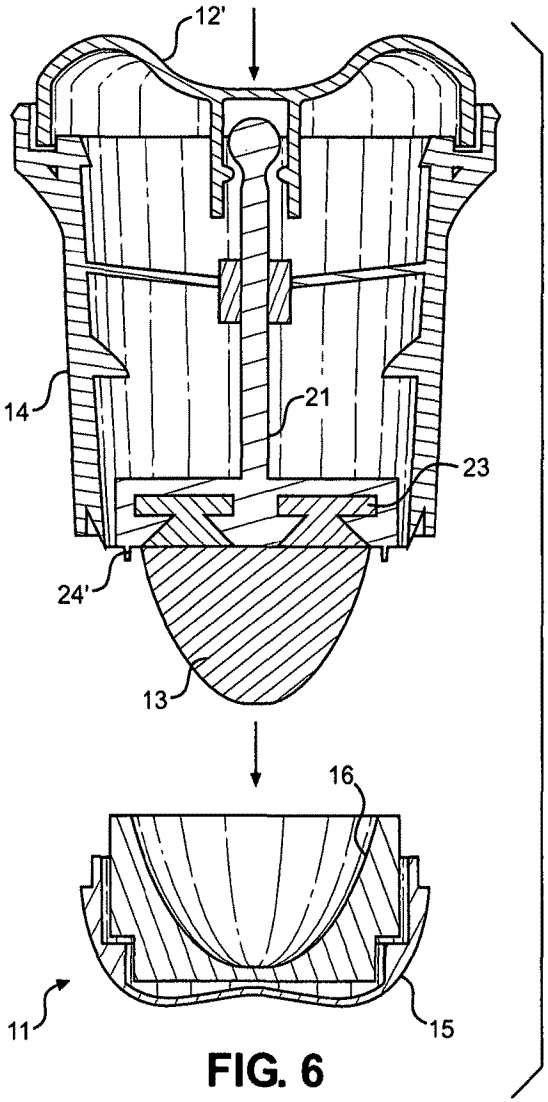
FIG. 6 is a view like that of FIG. 5 showing the concave shape of the base cap and the configuration thereof in the relaxed configuration and how it biases the stick product out of the housing when the end cap is removed.
Figure 5:
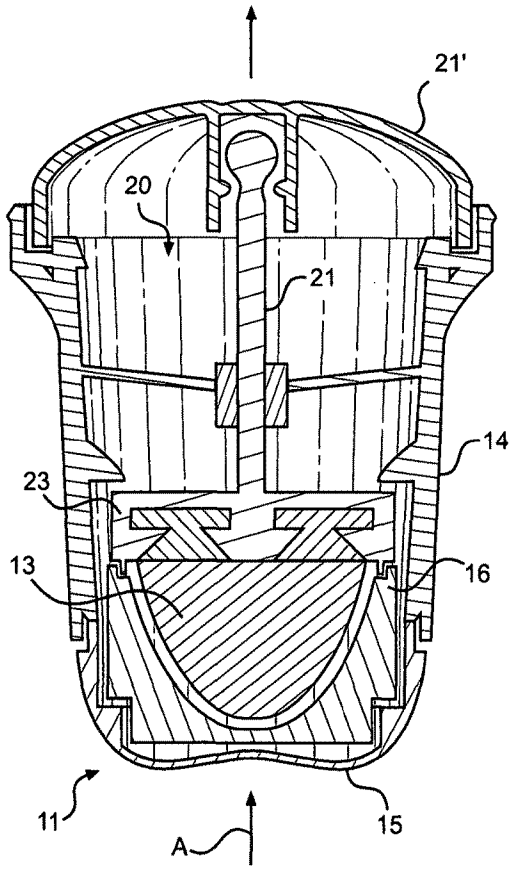
FIG. 5 is a view like that of FIG. 2 with a different type of base cap.

FIGS. 5 & 6 show another embodiment of an applicator according to the invention The primary difference between the invention illustrated in FIGS. 5 & 6 and what is illustrated in FIGS. 1-4 is the construction of the elastomeric material base cap 12'. The base cap 12' is molded with a concave configuration as illustrated in FIG. 6. That way, when the end cap 11 is removed, the semi-solid material (e. g. lip balm) 13 is biased out from the housing 14 by a spring action of the naturally concave cap 12'. This construction of the base cap 12' also provides a cushioning (or shock-absorbing) effect of the spring like action when applying the lip balm, or other semi-solid material 13, to a user's body.

To move the material 13 to the non-use position of FIG. 5 the outer textured end cap 15 of the end cap 11 is pushed upwardly as indicated by arrow A in FIG. 5 to bring the inner portion 16 of cap 11 into contact with the bottom of the housing 14. The inner portion hits a peripheral portion 24' of the bottom of tray 23 so that it preferably does not directly engage the material 13. The end cap inner portion 16 is then screwed (e. g. just ¼ turn) onto the main body 14 so that the cap 11 holds the material 13 in the position illustrated in FIG. 5, pushing the elastomeric material base cap 12' upwardly to a stressed convex position, as illustrated in FIG. 5.

In the FIGS. 5 & 6 embodiment the shaft 21 of the plunger 20 will be longer than in the FIGS. 1-4 embodiment and sturdier (e. g. larger diameter), but otherwise the other components are basically the same.

FIGS. 7-11 illustrate a preferred embodiment of applicator according to the invention, utilizing an enhanced form of the base cap 12, 12'. In the FIGS. 7-11 embodiment components comparable to those in the FIGS. 1-4 embodiment are shown by the same reference numeral only preceded by a "1."

The stick product semi-solid material applicator 110 of the FIGS. 7-11 embodiment comprises a generally tubular housing 114 having first and second open ends 60, 61, respectively. An elastomeric material base cap 112 closes the housing first end 60; the base cap 112, per se, according to this embodiment also may be utilized with other structures.

The base cap 112, illustrated in three different positions in FIGS. 7-10, is desirably of a thermoplastic material having properties comparable to those of urethane and preferably has a durometer on the Shore A scale of about 40-90 (e. g. about 70 A). The base cap 112 is preferably bistable, meaning that it is stable (relaxed) in both the inoperative (FIG. 9) and operative (FIGS. 7 & 10) positions thereof, and "snaps" from one to the other.

Figure 7:
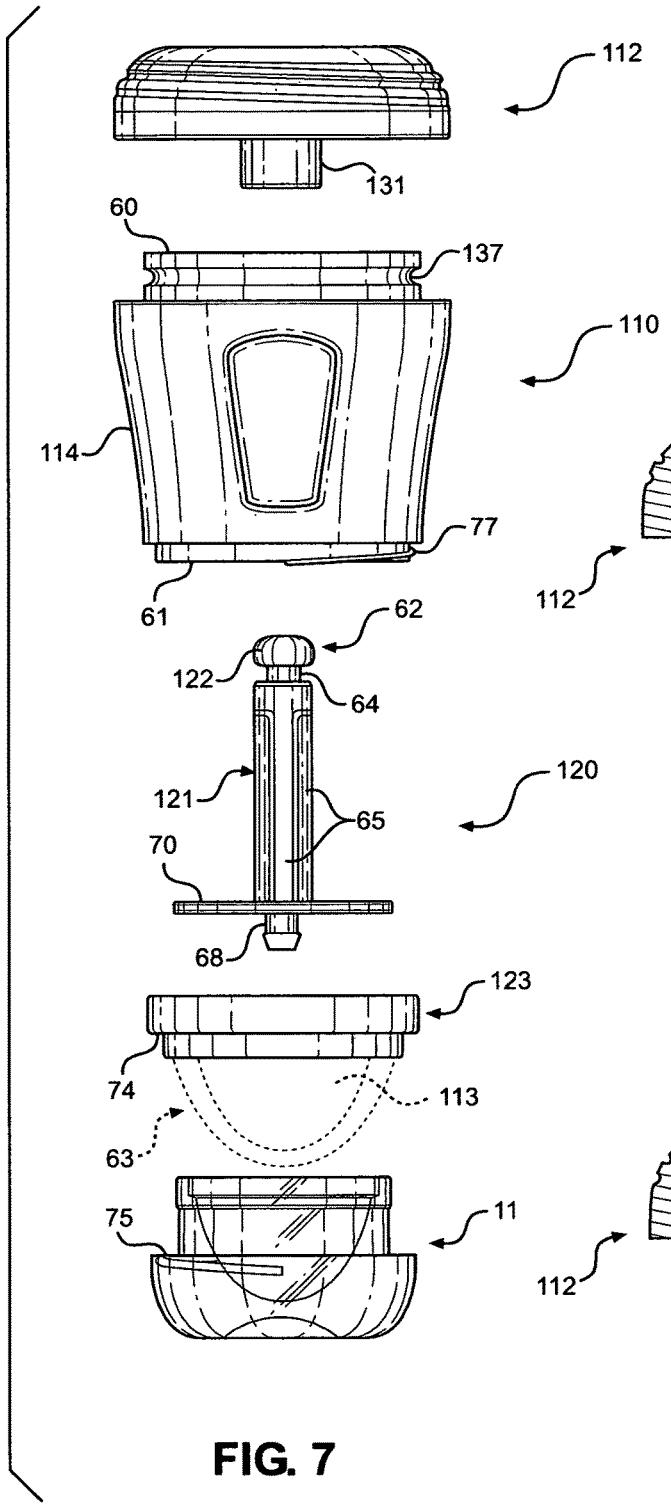
FIG. 7 is an exploded elevational view of a preferred exemplary embodiment of an applicator according to the present invention.
Figure 9:
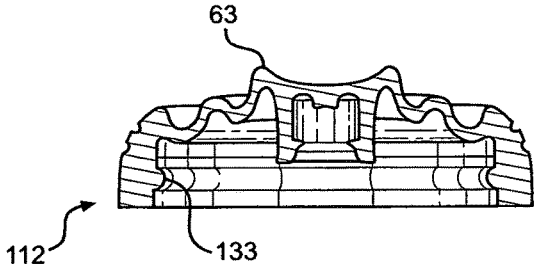
Figure 10:
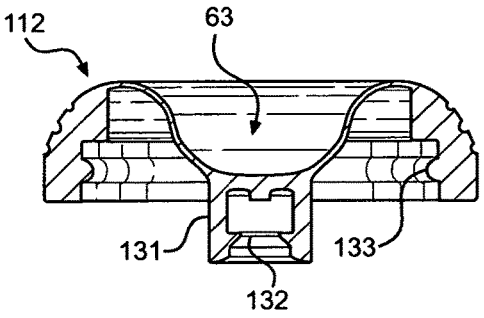
FIG. 10 is a cross-sectional view of the base cap of the FIG. 7 embodiment when in has been depressed by a user and snaps over to its position with the semi-solid mass extending substantially completely outwardly from the housing.

FIGS. 7 & 10 show the base cap 112 in its operative position after actuation (depression) by a user's finger. In FIGS. 7 & 10 the center portion of the "top" 63 thereof (as seen in FIG. 10) is concave after the base cap 112 has "snapped" from its relaxed, inoperative, position of FIG. 9 in which the top 63 is convex and the semi-solid mass 113 is primarily within the housing 114, to the operative position in which the mass 113 is substantially completely exterior of the housing 114 so as to be applied to a body part, or the like.

Figure 8:
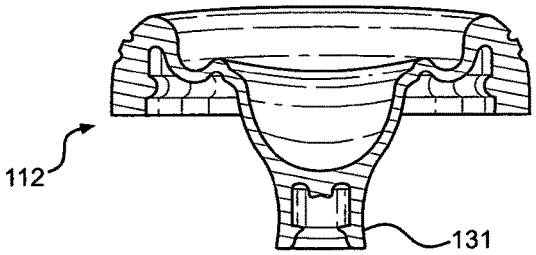
FIGS. 8 & 9 are schematic side cross-sectional views of the preferred base cap of FIG. 7 when in cartridge-replacing and applicator-closed positions, respectively.

FIG. 8 schematically illustrates base cap 112 in about the position that it would assume when depressed during replacement of a cartridge (e. g. a new plunger 120 with associated new semi-solid mass 113), while FIG. 9, again, shows the cap 112 when the end cap 111 is in engagement with the housing 114 closing off the open bottom 61 thereof so that the mass 113 is primarily or substantially completely within the housing 114.

The base cap 112 peripheral portion has surface manifestations, in the form of ring 133 in the embodiment illustrated in FIG. 10, on the inner surface thereof, for cooperation with the cooperating lip 137 (FIG. 7) of the housing 114 first end 60. The cap 112 may simply be pushed down on top of the housing 114 first end 60 and it will deform so that the ring 133 snaps into engagement with the lip 137, holding the elements 112, 114 securely together. Other surface manifestations aside from a ring and lip may be utilized or in some circumstances the elements 112, 114 may be permanently affixed together by adhesive, plastic welding, etc.

The applicator 110 also includes the plunger 120 having first and second ends 62, 63 respectively (FIG. 7). The first end 62 is operatively connected to the flexible material base cap 112 by engagement of the knob 122, having open space 64 beneath it as viewed in FIG. 7, with the surface manifestations (in the form of a ring 132 in the embodiment illustrated in FIG. 10) of the center tube 131 of the base cap 112. The plunger 120, in this embodiment, includes the shaft 121 having a plurality (e. g. four) of vertical ribs 65, and the tray 123 is connectable by locking ribs 68 (FIG. 7) and 69 (FIG. 11) to the bottom of the plunger shaft 121. In this embodiment between the locking rib 68 and the ribs 65 a preferably unapertured disc 70 is provided integral with the rest of the shaft 121. The purpose of the disc 70 is to cover the top of the semi-solid mass 113 to protect it from air within the housing 114 and thereby extend the effective life of the mass 113.

Figure 11:
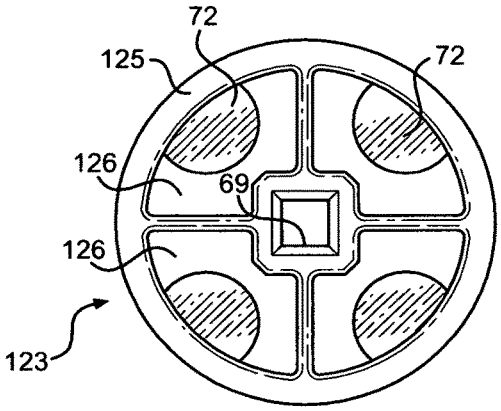
FIG. 11 is a top plan view of the plunger tray of the FIG. 7 embodiment.

The tray 123 preferably has the configuration seen most clearly in FIG. 11. It includes the peripheral side wall 125 and the plurality of openings 126 provided therein, and tabs or other surface manifestations 72 which help to define the openings 126.

The applicator 110 further comprises the mass of semi-solid material stick product 113 mounted on the second end 63 of the plunger 120; specifically the mass 113 fills substantially the entire area within the peripheral side wall 125 of tray 123, and engages the tabs 72, and extends from the tray 123 through the openings 126 well past the tray 123 as indicated in FIG. 7.

While the removable end cap 11 in the FIGS. 1-6 embodiments comprises two different portions, preferably the end cap 111 in the FIGS. 7-11 embodiment is a single structure covering the housing 114 second end 61 movable from a first position in which it covers the semi-solid material 113 to preclude access thereto, and a second position in which the semi-solid material 113 extends partially out of the second end 63 of the housing 114 before the base cap 112 is moved from the FIG. 9 to the FIG. 10 position, and a third position wherein the mass 113 is substantially completely exterior of the housing 114 (see FIG. 18) after the base cap 112 has been moved to the FIG. 10 position. The end cap 111 is desirably of transparent plastic such as PETG.

As seen in FIG. 7, the tray 123 has a peripheral section 74 devoid of semi-solid material 113, and the end cap 111 has an annular extension 75 which engages the peripheral section 74 to move the semi-solid material 113 from the second position described above to the first position thereof without necessarily engaging the mass 113 itself. The annular section 75 also has surface manifestations—such as an internal screw thread (not shown)—which engage cooperating surface manifestations (e. g. external screw threads) 77 on the second end of the housing 114 to releasably hold the end cap 111 onto the housing 114 and prevent exterior air from drying out the mass 113. Alternatively surface manifestations like 49, 50 in the FIGS. 1-4 embodiment may be provided. It is desirable that the surface manifestations provide a "click" when the end cap 111 has been securely attached to the housing 114.

Figure 17:
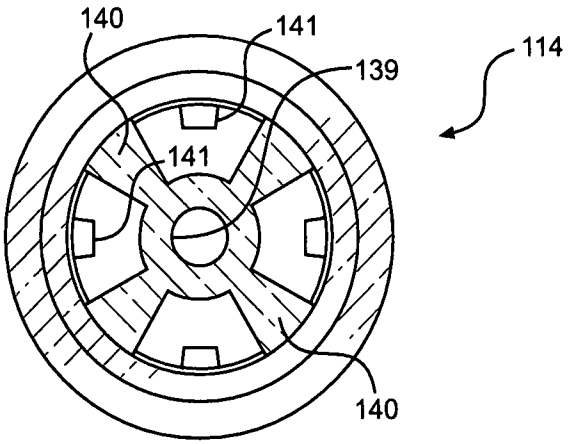
FIG. 17 is a top plan view of the housing of the FIG. 7 embodiment.

The housing 114 also preferably has a guide 139 (FIG. 17) mounted therein between the first and second ends 60, 61, thereof. Element 139 guides reciprocal movement of the plunger shaft 121. The guide 139 is preferably supported by a plurality of ribs 140 which also provide a housing-strengthening function. The diameter of the opening in the guide 139 is just slightly larger than the diameter (with ribs 65) of the shaft 121 and knob 122. Stops 141 (FIG. 17) are also desirably provided in the interior of the generally tubular housing 114.

Figure 12:
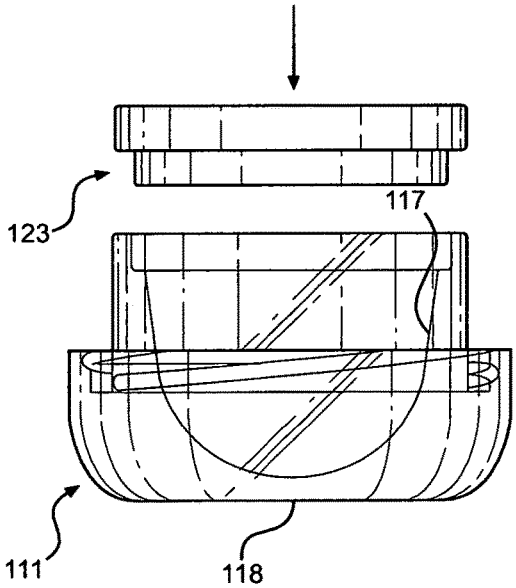
FIGS. 12-14 sequentially illustrate the assembly of a stick product cartridge for the applicator of FIG. 7.
Figure 13:
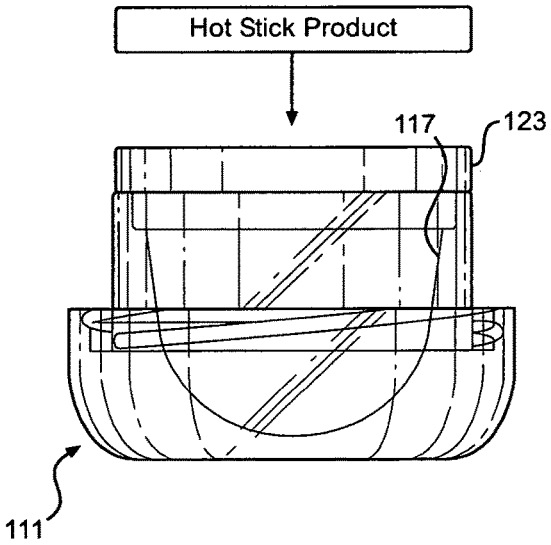
Figure 14:
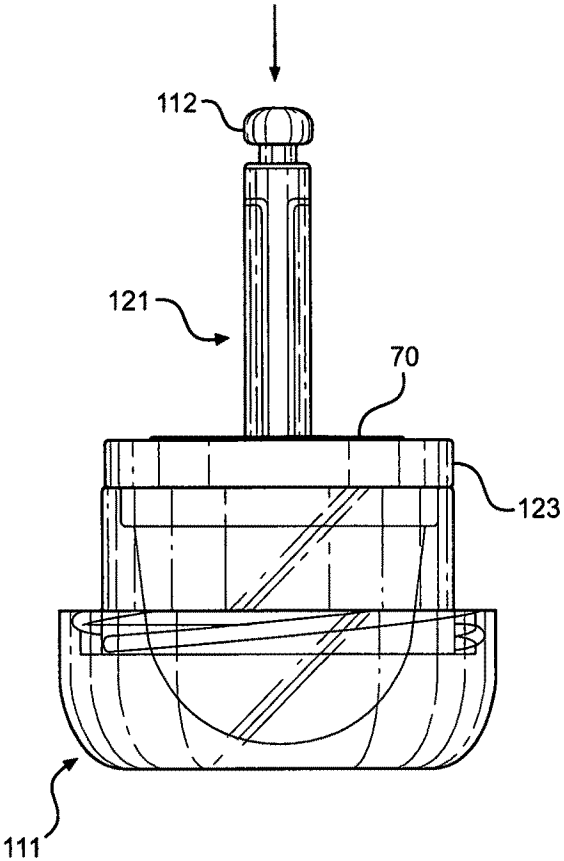

FIGS. 12-14 show an exemplary method of assembling an applicator 110 including by making a cartridge of semi-solid material 113. As seen in FIG. 12, the tray 123 is inserted into the open top of the end cap 111, which has a molding surface 117 interior thereof. Then as seen in FIG. 13, hot, or otherwise flowable and curable, stick product is poured into the tray 123. The flowable mass of stick product will flow through the openings 126 (FIG. 11) in the tray 123 to contact the mold surface 117. Once the stick product has cooled or otherwise set to form the semi-solid mass 113 which is integrally bound to the tray 123, as seen in FIG. 14 the shaft 121 will be pushed downwardly so that the locking projections 68 (FIG. 7) and 69 (FIG. 11) on the shaft 121 and tray 123 will hold them together, with the disc 70 covering the top of the mass 113. Thus a new cartridge of plunger 120 and semi-solid mass 113 is formed.

The new cartridge of plunger 120/mass 113 may be inserted into the housing 114. First the base cap 112 is depressed into the position approximately illustrated in FIG. 8 and the old plunger shaft 121 is removed. Then the new shaft 121 is passed through the guide 139 so that the knob 122 thereof moves past the ring 132 of tube 131 connecting the base cap 112 with the new cartridge.

Figure 15:
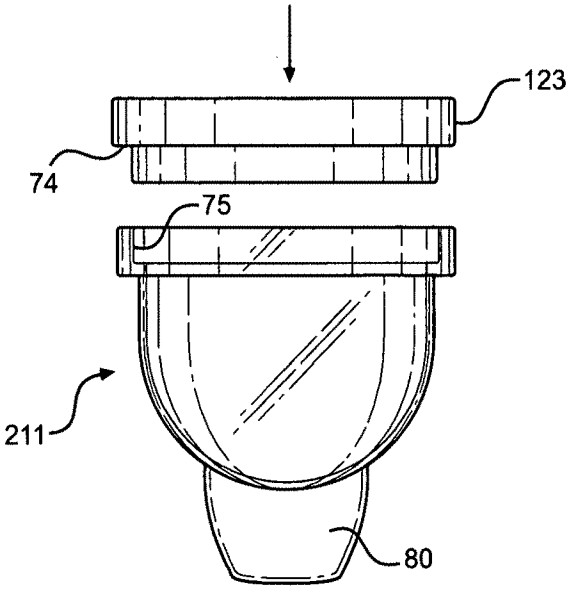
FIG. 15 is a view like that of FIG. 12 showing the type of end cap typically used for a replacement cartridge.

FIG. 15 shows an embodiment with an alternative configuration of end cap, indicated by reference numeral 211. The end cap 211 has a mold interior surface (not shown) similar to that (117) of the end cap 111, and the surface 75 engaging a cooperating surface 74 of the tray 123 is at the upper end (as viewed in FIG. 15) thereof. A tab 80 is provided integral with the end cap 211 to facilitate detachment of the semi-solid mass 113 from the end cap 211 once the semi-solid mass has sufficiently cooled, or otherwise set. The end cap 211 configuration is particularly desirable for use with replacement cartridges, and once the cartridge is replaced the end cap 211 is discarded, and the end cap 111 is utilized.

Figure 16:
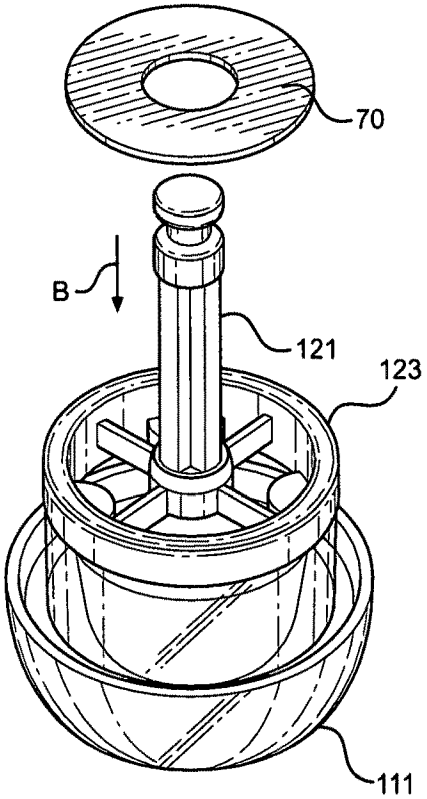
FIG. 16 is a top perspective view of a one piece plunger shaft and tray embodiment showing a semi-solid mass covering disc about to be placed in operative association therewith.

FIG. 16 shows another embodiment of the plunger 120 which is preferred in some circumstances. In this embodiment the plunger shaft 121 and tray 123 are integral with each other, but the disc 70 is initially detached. After the semi-solid mass 113 is formed (integral with the tray 123) then the disc 70 is moved downwardly—as indicated by arrow B in FIG. 16—over the shaft 121 to cover the mass 113. A plurality of conventional locking tabs, or like surface manifestations (not shown in FIG. 16), are provided on the tray 123 just below the shaft 121 so that when the disc 70 is pushed in the direction of arrow B to its seated position it snaps over the locking tabs and is held in place covering the mass 113.

Figure 18:
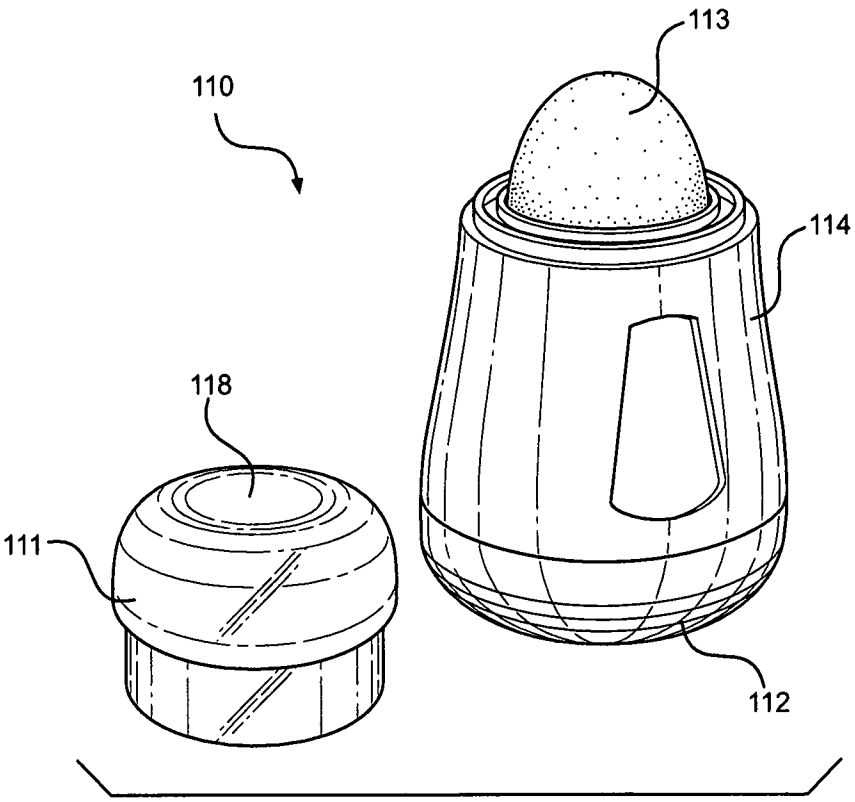
FIG. 18 is a perspective view, with the end cap removed, of an applicator according to the invention with a configuration like that in the FIG. 7 embodiment only having a housing with at least one substantially flat side wall.

An exemplary final product, illustrated at 110 in FIG. 18, can rest on any surface, either the base cap 112 engaging a support surface, or the flat surface 118 engaging the support surface. The applicator 110 shown in in FIG. 18 is in the operative position in which the bistable base cap 112 has been moved from the FIG. 9 to the FIG. 10 positions so that the mass 113 is substantially completely exterior of the housing 114 and available for application to a user's body.

All general ranges set forth above include each and every individual range or value within the general range. Also, the applicator can be of any size desired, which will vary depending upon the type of semi-solid material utilized, and the semi-solid mass can have any desired shape again depending upon the exact material. The invention is to be accorded the broadest interpretation of the appended claims, limited only by the prior art, so as to encompass all equivalent structures, devices, and methods.

What is claimed is:

1. A stick product semi-solid material applicator comprising:

a generally tubular housing having first and second open ends;

an elastomeric material base cap closing said housing first end;

a plunger having first and second ends, said plunger first end operatively connected to said flexible material cap;

a mass of semi-solid material stick product mounted on said second end of said plunger; and at least one readily removable end cap covering said housing second end and movable from a first position in which it covers said semi-solid material to substantially preclude access thereto, and a second position in which said semi-solid material can extend at least partially out of said second end of said housing; and wherein said elastomeric material base cap is a bistable element which moves from a first stable configuration in which said semi-solid material is primarily within said housing to, after removal of said end cap and manual actuation thereof, a second stable configuration in which said semi-solid mass is substantially completely exterior of said housing.

2. An applicator as recited in claim 1 wherein said elastomeric material base cap is concave in its relaxed configuration so as to bias said semi-solid material to said second position extending at least partially out of said second end of said housing.

3. An applicator as recited in claim 1 wherein said at least one end cap comprises a mold for the semi-solid material to allow in situ molding thereof on said plunger.

4. An applicator as recited in claim 1 further comprising compatible surface manifestations on said housing adjacent said second end thereof, and on said end cap, to provide releasable locking connection of said end cap to said housing.

5. An applicator as recited in claim 1 wherein said plunger comprises a shaft, and a tray which holds said semi-solid material, said tray having a peripheral section devoid of semi-solid material; and wherein said end cap engages said peripheral section to move said semi-solid material and said bistable base cap from said second position to said first position thereof without disturbing said semi-solid mass.

6. An applicator as recited in claim 5 wherein said plunger also comprises a disc adjacent said second end of said shaft which cooperates with said tray to minimize contact of said semi-solid material with air inside said housing.

7. An applicator as recited in claim 5 wherein said plunger shaft and tray have cooperating surface manifestations to allow releasable connection of one to the other.

8. An applicator as recited in claim 1 wherein said plunger has a knob and recess at said first end thereof which cooperates with surface manifestations on said elastomeric material base cap to allow ready replacement of said plunger and semi-solid material mass.

9. An applicator as recited in claim 1 wherein said generally tubular housing has tapering side walls at least one of which is substantially flat.

10. An applicator as recited in claim 1 wherein said end cap is operatively connected to and disconnectable from said housing by screw threads, and wherein said end cap is transparent so that the stick product may be viewed even when the end cap is screw threaded onto said housing.

11. An applicator as recited in claim 1 wherein said elastomeric material base cap is made of a thermoplastic material with properties comparable to those of urethane and having a durometer of between about 40-90 on the Shore A scale.

12. A stick product semi-solid material applicator comprising:

a generally tubular housing having first and second open ends;

an elastomeric material base cap closing said housing first end;

an elongated plunger shaft having first and second ends, said plunger shaft first end operatively connected to said flexible material cap;

a mass of semi-solid material stick product operatively connected to said second end of said plunger shaft;

at least one readily removable end cap covering said housing second end and movable from a first position in which it covers said semi-solid material to substantially preclude access thereto, and a second position in which said semi-solid material can extend at least partially out of said second end of said housing;

a guide mounted within said housing between said first and second ends thereof which guides reciprocal movement of said elongated plunger shaft; and at least one stop in the interior of said housing between said first and second ends thereof for stopping the movement of said elongated plunger shaft in a desired position.

13. A method of assembling an applicator unit with a semi-solid stick product, the applicator unit including a plunger shaft, a plunger tray having openings and surface manifestations therein, an end cap having an open top and a bottom in the form of a mold, and a generally tubular applicator housing, by: a) placing the tray on the open top of the end cap; b) filling the bottom of the end cap with a flowable stick product so that it passes through the openings in the plunger tray and engages the surface manifestations; c) allowing the flowable stick product to cool or otherwise set into a semi-solid mass attached to the plunger tray but not attached to the end cap; d) insuring that the plunger shaft is in operative association with the plunger tray so that the tray and semi-solid mass move with the plunger shaft; e) moving an end of the plunger shaft opposite the tray into contact with the elastomeric material end cap; and wherein the elastomeric material base cap is a bistable elastomeric material base cap, and further comprising: f) pushing the end cap into operative association with surface manifestations on the end of the housing opposite the base cap so that they releasable lock together; and g) removing the end cap and acting on the bistable base cap so that the base cap biases the semi-solid mass of stick product out of the housing for use on a user's body.

14. A method as recited in claim 13 further comprising h) replacing the end cap so that it operatively engages the plunger to move the semi-solid mass of stick product back toward the housing, automatically causing the bistable base cap to move back to the position it was in during f).

15. A method as recited in claim 13 wherein f) is practiced by screw threading the end cap to the housing.

16. A cap for an applicator, comprising:

a bistable body of elastomeric material having a peripheral portion with inner and outer surfaces, and a center portion with top and bottom surfaces, said center portion top surface having a convex shape in a first relaxed configuration, and a concave shape in a second relaxed configuration, and said center portion bottom surface having a depending center tubular element;

surface manifestations in the interior of said center tubular element for cooperation with a knob and recess of a plunger; and surface manifestations on the inner surface of said peripheral portion for cooperation with a housing for an applicator.

17. A cap as recited in claim 16 made of a thermoplastic material with properties comparable to those of urethane and having a durometer of between about 40-90 on the Shore A scale.

18. A stick product semi-solid material applicator comprising:

a generally tubular housing having first and second open ends;

an elastomeric material base cap closing said housing first end;

a plunger having first and second ends, said plunger first end operatively connected to said flexible material cap;

a mass of semi-solid material stick product mounted on said second end of said plunger; and at least one readily removable end cap covering said housing second end and movable from a first position in which it covers said semi-solid material to substantially preclude access thereto, and a second position in which said semi-solid material can extend at least partially out of said second end of said housing; and wherein said elastomeric material base cap is concave in its relaxed configuration so as to bias said semi-solid material to said second position extending at least partially out of said second end of said housing.

19. An applicator as recited in claim 18 wherein said plunger has a knob and recess at said first end thereof which cooperates with surface manifestations on said elastomeric material base cap to allow ready replacement of said plunger and semi-solid material mass.

20. An applicator as recited in claim 18 wherein said plunger comprises a shaft, and a tray which holds said semi-solid material, said tray having a peripheral section devoid of semi-solid material; and wherein said end cap engages said peripheral section to move said semi-solid material and said bistable base cap from said second position to said first position thereof without disturbing said semi-solid mass.

* * * * *